United States Patent [19]

Heseltine

[11] Patent Number: 4,575,090

[45] Date of Patent: Mar. 11, 1986

[54] PUTTING AID

[76] Inventor: Barry E. Heseltine, 1 New England Dr., Kingsgrove, New South Wales, 2208, Australia

[21] Appl. No.: 649,603

[22] Filed: Sep. 12, 1984

[51] Int. Cl.[4] ..... A63B 69/36

[52] U.S. Cl. ..... 273/183 D; 273/162 B; 273/163 R

[58] Field of Search ..... 273/162 B, 194 A, 163 R, 273/183 D, 183 E, 163 A, 164, 35 A

[56] References Cited

U.S. PATENT DOCUMENTS

| | | | |
|---|---|---|---|
| 2,976,046 | 3/1961 | McCullough | 273/162 B |
| 3,810,633 | 5/1974 | Scott | 273/194 A X |
| 3,909,004 | 9/1975 | Vella | 273/162 B |

FOREIGN PATENT DOCUMENTS

| | | | |
|---|---|---|---|
| 223044 | 10/1924 | United Kingdom | 273/194 A |
| 2130895 | 6/1984 | United Kingdom | 273/163 R |

*Primary Examiner*—George J. Marlo

*Attorney, Agent, or Firm*—Emory L. Groff, Jr.

[57] ABSTRACT

An aid for persons wishing to improve the golf stroke known as putting. The aid comprises two planar surfaces with a relfex angle of between 127 and 140 degrees therebetween. One surface is reflective and supports a cylindrical leveling device in a cylindrical channel while the other is intended to replace the ball striking face of a putting club. The aid is mounted on the putting club with the other surface in its intended position and the levelling device in a levelling plane which is substantially parallel to the line of intersection of the planes which include the two planar surfaces.

2 Claims, 3 Drawing Figures

PUTTING AID

This invention provides a sighting device to assist in the art of putting on a golf course green. The device is for use during putting practice and is so constructed that it can be readily removed from the putting club prior to use in competitive play as the aid proposed by this invention has not been approved for use in such play.

The art of putting involves placing the ball striking face of the putter head at right-angles to the direction of proposed travel of the ball and then moving the putter head in an arcuate manner, as the weight of a pendulum, and striking the ball whilst the right-angle relationship is maintained. To assist with lining up the putter face at right-angles to the line of proposed ball travel it is common, and approved by the controlling bodies for golf, to have sighting marks, such as lines on, or grooves in, the putter head at right-angles to the putter face. The marks may extend into auxiliary parts fixed to the putter head. Such sighting marks are allowable under the rules of golf mainly because they are considered as still requiring the golfer to exercise a high degree of judgement in establishing the right angle relationship between the putter striking face and the line between the hole in the green and the ball. With the aid proposed by the present invention squareness of the striking face of the putter to the line between the ball and the hole in the green can be very accurately established.

Very generally the present invention provides an attachment for mounting on a putter, the attachment includes a reflective means which allows the ball and the flagstick in the hole in the green to be observed at the same time. The club face is then moved to align the ball with the flagstick, or some other object on the green when the ball is to travel in a direction other than directly towards the hole, as for example as might be required when allowing for the slope of a putting green between the ball and the hole. A cross-slope on a putting green can, with experience with the putting aid, become readily discernible thereby allowing the golfer to make appropriate allowance for the slope when planning his putting stroke.

More specifically, the invention provides a putting aid comprising a reflective member with a subatantially flat reflective surface and a ball striking member with a substantially flat striking surface, the reflective and striking surfaces are in planes which intersect with a reflex angle therebetween, the line of intersection of said planes being a datum line, a levelling device mounted on the putting aid so that a level indicator forming part of the levelling device lies in a levelling plane which is substantially parallel to the datum line and attachment means to allow the putting aid to be mounted on a putting club with the striking surface of the putting aid substantially parallel to the ball striking face of the putter.

The invention in a presently preferred form will now be described with reference to the accompanying drawings in which.

Figure 1:
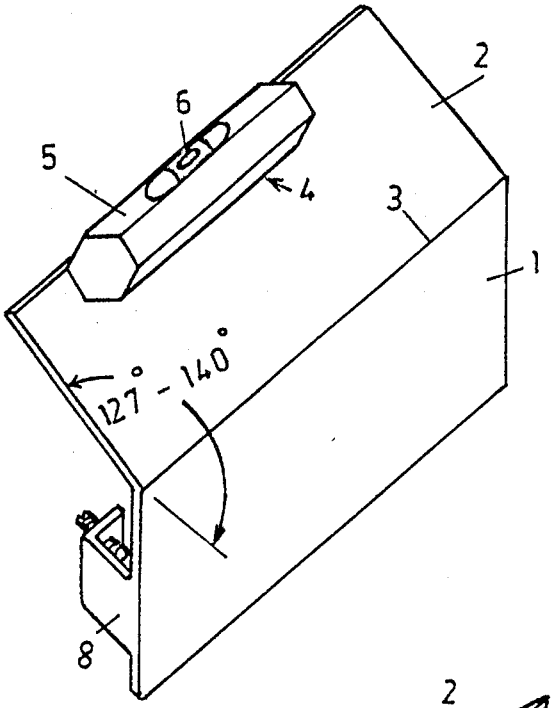
FIG. 1 is a perspective view of a first form of the invention

The putting aid comprises a pair of surfaces 1 and 2 which are in planes which intersect at a reflex angle, preferably in the range of 127 to 140 degrees and desirably at an angle of 132 degrees. The surface 2 is reflective and is preferably a highly polished surface of a piece of non-oxidising metal, such as stainless steel. The surface 1 can be polished or have a matt finish, much like the ball hitting surface of many commercially available putting clubs. As shown the surfaces are parts of a single piece of sheet metal with a bend line 3, hereinafter called a datum line because of its relevance to the positioning of another part of the putting aid, where the planes occupied by the surfaces 1 and 2 intersect.

There is a levelling device 4 of the elongated tube type in a housing 5 fixed to the surface 2, although it may be mounted elsewhere even as an extension of the striking face 1 if this is practical. The levelling device 4 is positioned so that the level indicator, the bubble 6, lies in a levelling plane (the horizontal plane) and the datum line is substantially parallel to the levelling plane.

Figure 2:
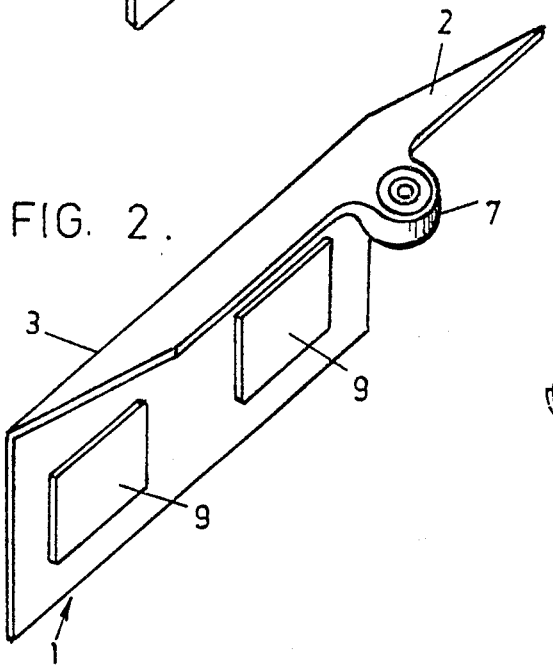
FIG. 2 is a view similar to FIG. 1 wherein a different type of levelling device is shown and FIG. 3 is an end view of a third form of the invention mounted on a putter blade.

In the FIG. 2 arrangement the elongated tube type levelling device 4 is replaced by a circular levelling device 7 with the advantage over the device 4 that the angle of the surface 1 of the putting aid to the vertical plane, when the putting aid is mounted on a putting club, can be determined as well as the relationship of the datum line to the horizontal. This is a positive assistance to come golfers who tend to "hood" the putting stroke by having their hands on the putter grip in advance (in the direction of the hole) of the ball striking surface of the putting club. The result is an acute angle between the ball striking surface of the putting club and the surface of the putting green. Hooding effects the roll of the ball over the green and can lead to concern on the part of the golfers as to why the golf ball performed in a particular way in its travel to the hole. Hooding as a reason for possible bad ball roll could be readily eliminated with the proposed circular levelling device because the angular relationship of the ball striking surface to the vertical plane can be readily established and if required adjustments can be made to the position of the golfers hands.

Figure 3:
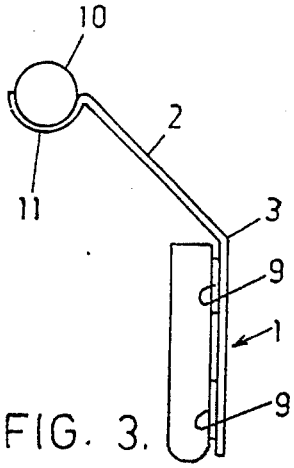

The putting aid is designed to be mounted on a putting club so that the surface 1 lies in front of the ball striking face of the putter (see FIG. 3). Many alternative arrangements are possible for the mounting of the putting aid on the putter. In FIG. 1 a clamp 8 is illustrated. In FIG. 2 two pads 9 of double sided adhesive tape are used. The object is to mount the putting aid so that the surface 1 thereof and the ball striking face of the putter are in parallel planes, to have the aid readily mountable and removable and to not damage the putter ball striking face.

In FIG. 3 a short cylindrical levelling vial 10 is housed in a channel part 11 of the member 2.

The preferred embodiments of the invention described above may be changed without departing from the essential features of the invention which are set forth in the accompanying claims. For example the aid may be made other than by folding a single piece of sheet metal to provide the surfaces 1 and 2. The shapes of the surfaces 1 and 2 need not be rectangular, the levelling device can be mounted by gluing, rivetting or the like and need not be affixed to the reflective surface.

I claim:

1. A putting aid to be mounted on the blade of a golf putting club, said putting aid comprising a sheet of foldable metal with a width substantially the same as the length of the blade of a putting club on which the putting aid is to be mounted, a straight line bend across the front face of the sheet in the width direction to provide a first surface for reflection means and a second ball striking surface with a reflex angle therebetween, a channel in the first surface located remotely from the straight line bend in the sheet with the channnel sides parallel to the straight line bend, and an elongated levelling device permanently mounted in the channel so that the level indicating part of the levelling device lies in a levelling plane that is parallel to the straight line bend.

2. A putting aid as claimed in claim 1 including adhesive pads on the back face of said sheet behind the ball striking surface to allow the putting aid to be removably mounted on a putting club with the ball striking surface of the putting aid overlying the ball striking face of the putting aid.

* * * * *